US009761395B2

(12) United States Patent
Jimbo et al.

(10) Patent No.: US 9,761,395 B2
(45) Date of Patent: Sep. 12, 2017

(54) GAS CIRCUIT BREAKER

(71) Applicant: KABUSHIKI KAISHA TOSHIBA, Tokyo (JP)

(72) Inventors: Tomohiko Jimbo, Kanagawa (JP); Biswas Debasish, Saitama (JP); Takeshi Shinkai, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 15/193,531

(22) Filed: Jun. 27, 2016

(65) Prior Publication Data

US 2016/0379780 A1 Dec. 29, 2016

(30) Foreign Application Priority Data

Jun. 29, 2015 (JP) ..... 2015-130299

(51) Int. Cl.
*H01H 33/82* (2006.01)
*H01H 33/88* (2006.01)
*H01H 33/74* (2006.01)

(52) U.S. Cl.
CPC ..... *H01H 33/82* (2013.01); *H01H 33/74* (2013.01); *H01H 33/88* (2013.01)

(58) Field of Classification Search
CPC ..... H01H 1/66; H01H 2033/906; H01H 2033/908; H01H 2050/025; H01H 2239/072; H01H 33/56; H01H 33/74; H01H 33/78; H01H 33/82; H01H 33/91;
(Continued)

(56) References Cited

U.S. PATENT DOCUMENTS 4,163,131 A * 7/1979 Perkins ..... H01H 33/91 218/65
4,220,838 A * 9/1980 Thaler ..... H01H 33/91 218/66

(Continued)

FOREIGN PATENT DOCUMENTS

JP 6-101284 12/1994
JP 2000-294095 10/2000

(Continued)

*Primary Examiner* — Truc Nguyen
(74) *Attorney, Agent, or Firm* — Finnegan, Henderson, Farabow, Garrett & Dunner, L.L.P.

(57) ABSTRACT

In a gas circuit breaker according to an embodiment, a container is filled with an arc extinguishing gas. A movable part housed in the container and includes a movable arc contact. The movable part is provided with an accumulation part for increasing pressure of the arc extinguishing gas. A counter part is housed in the container and includes a counter arc contact, an exhaust pipe, and a shield. The shield is disposed in the exhaust pipe in a state that a flow of the arc extinguishing gas inside the exhaust pipe is allowed. A nozzle is housed in the container and provided with a space. An arc discharge occurs between the movable arc contact and the counter arc contact in the space. The arc extinguishing gas having an increased pressure in the accumulation part flows into the space to extinguish the arc discharge and flows into the exhaust pipe. The shield has a first shield wall crossing the axial direction of the exhaust pipe.

20 Claims, 13 Drawing Sheets

(58) Field of Classification Search
CPC ..... H01H 50/00; H01H 50/38; H01H 50/54; H01H 50/546
See application file for complete search history.

(56) References Cited

U.S. PATENT DOCUMENTS 4,291,208 A * 9/1981 Cromer ..... H01H 33/7023 218/62
4,440,997 A * 4/1984 Garzon ..... H01H 33/903 218/61
4,517,425 A * 5/1985 Martin ..... H01H 33/901 218/66
4,553,008 A * 11/1985 Veverka ..... H01H 33/88 218/117
4,577,073 A * 3/1986 Talpo ..... H01H 33/901 218/59
5,793,597 A * 8/1998 Mizufune ..... H01H 33/7015 218/52
5,978,200 A * 11/1999 Konma ..... H01H 33/91 218/157
2007/0068904 A1* 3/2007 Dahlquist ..... H01H 33/74 218/59
2007/0295693 A1 12/2007 Saxl et al.
2013/0126481 A1* 5/2013 Ozil ..... H01H 33/901 218/157
2013/0168357 A1* 7/2013 Yaginuma ..... H01H 33/08 218/57
2014/0251957 A1* 9/2014 Cernat ..... H01H 33/7015 218/51
2015/0170858 A1* 6/2015 Kotsuji ..... H01H 33/78 218/57
2015/0294820 A1* 10/2015 Kim ..... H01H 33/72 218/59

FOREIGN PATENT DOCUMENTS

JP 2007-35518 2/2007
JP 2007-95680 4/2007
JP 2012-69348 4/2012
JP 2014-89899 5/2014
JP 2007-35518 1/2015
JP 2015-11911 1/2015

* cited by examiner

GAS CIRCUIT BREAKER

CROSS-REFERENCE TO RELATED APPLICATIONS

This application is based upon and claims the benefit of priority from Japanese Patent Application No. 2015-130299, filed on Jun. 29, 2015; the entire contents of which are incorporated herein by reference.

FIELD

Embodiments described herein relate generally to a gas circuit breaker.

BACKGROUND

Conventionally, there has been known a gas circuit breaker which includes two contact parts constituting an electrical circuit. The gas circuit breaker extinguishes arc discharge generated between the two contact parts by injecting an arc extinguishing gas.

In this kind of gas circuit breaker, for example, it would be beneficial that the arc discharge can be extinguished more smoothly and more reliably.

DETAILED DESCRIPTION

Figure 1:
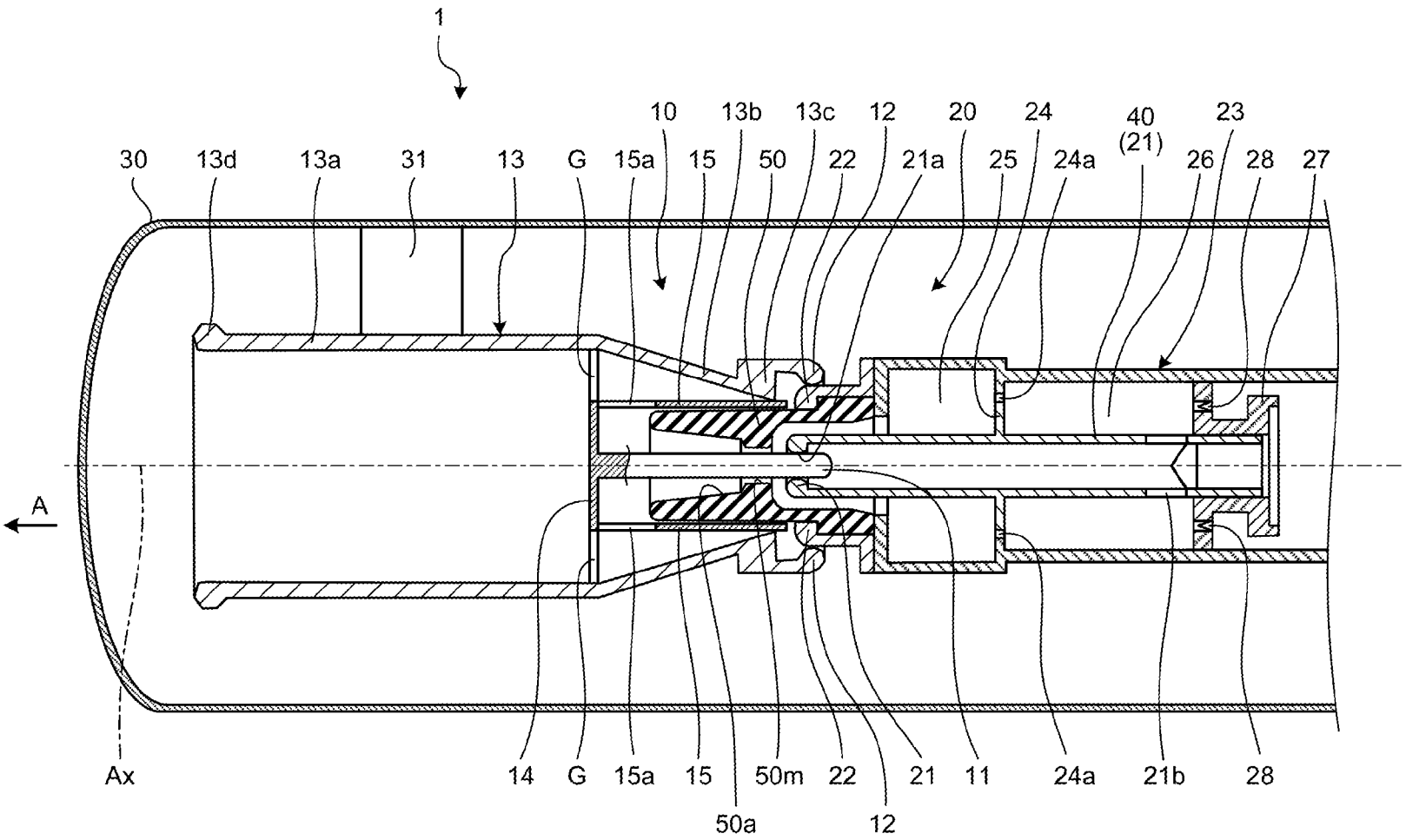
FIG. 1 is a schematic and exemplary cross-sectional view, along the axial direction, of a gas circuit breaker according to a first embodiment, and is a diagram illustrating a connected state.

In general, according to one embodiment, a container is filled with an arc extinguishing gas. A movable part housed in the container and includes a movable arc contact. The movable part is provided with an accumulation part for increasing pressure of the arc extinguishing gas. A counter part is housed in the container and includes a counter arc contact, an exhaust pipe, and a shield. The shield is disposed in the exhaust pipe in a state that a flow of the arc extinguishing gas inside the exhaust pipe is allowed. A nozzle is housed in the container and provided with a space. An arc discharge occurs between the movable arc contact and the counter arc contact in the space. The arc extinguishing gas having an increased pressure in the accumulation part flows into the space to extinguish the arc discharge and flows into the exhaust pipe. The shield has a first shield wall crossing the axial direction of the exhaust pipe.

Hereinafter, exemplary embodiments of the invention are described below. Herein, configurations and controls (the technical features) described in the embodiments, as well as functionality and results (the effect) achieved due to the configurations and the controls are only exemplary. Moreover, in a plurality of embodiments described below, identical constituent elements are included. Such identical constituent elements are referred to by the same reference numerals, and the relevant explanation is not repeated.

First Embodiment

A gas circuit breaker 1 includes two contact parts 10 and 20 that constitute an electrical circuit. The gas circuit breaker 1 switches between two states, namely, a connected state (FIG. 1) in which the two contact parts 10 and 20 are connected to each other and a cut-off state (FIGS. 2 and 3) in which the two contact parts 10 and 20 are cut off from each other. In the cut-off state occurring after the connected state, an arc discharge generates between the two contact parts 10 and 20. If the flow of an arc extinguishing gas is blown onto the arc discharge, then the arc discharge is cooled and is extinguished at current zero. The connected state can be called a closing state. The cut-off state can be called an opening state.

As illustrated in FIG. 1, the gas circuit breaker 1 includes an airtight container 30 that is filled with an arc extinguishing gas. For example, the airtight container 30 is made of a metallic material or an insulator, and is grounded. Herein, the airtight container 30 represents an example of a container. The airtight container 30 can be called an enclosure or a housing.

The arc extinguishing gas is, for example, sulfur hexafluoride gas (SF6 gas), air, carbon dioxide, oxygen, nitrogen, or a mixed gas thereof that has excellent arc extinguishing capacity and excellent insulating capacity. Alternatively, the arc extinguishing gas can be a gas that, for example, has a lower global warming potential and a smaller molecular weight than SF6 gas, and remains in the gas phase at least at 1 atmospheric pressure or above and at 20° C. or below.

Figure 2:
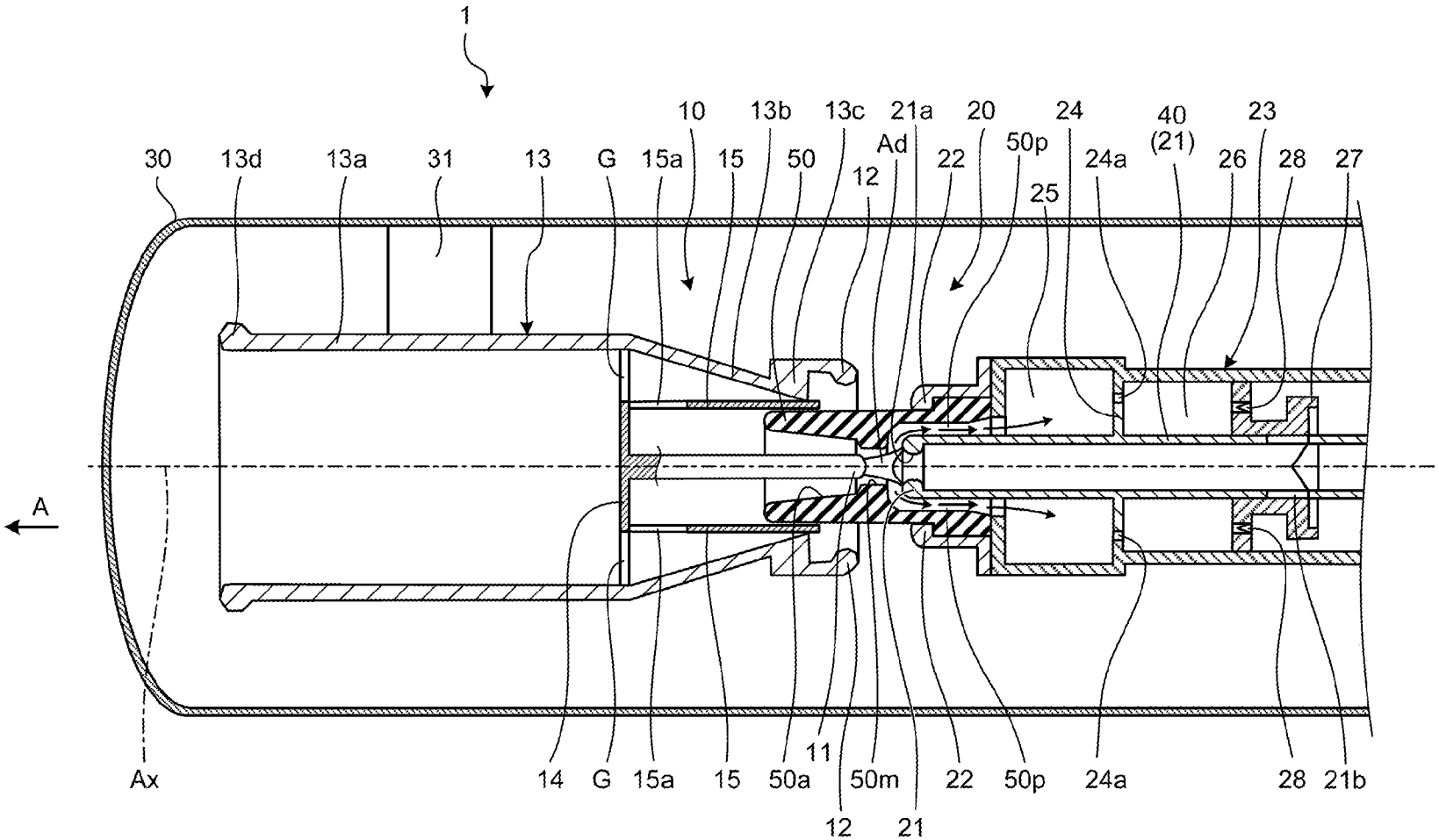
FIG. 2 is a schematic and exemplary cross-sectional view, along the axial direction, of the gas circuit breaker according to the first embodiment, and is a diagram illustrating a cut-off state occurring after the connected state illustrated in FIG. 1.
Figure 3:
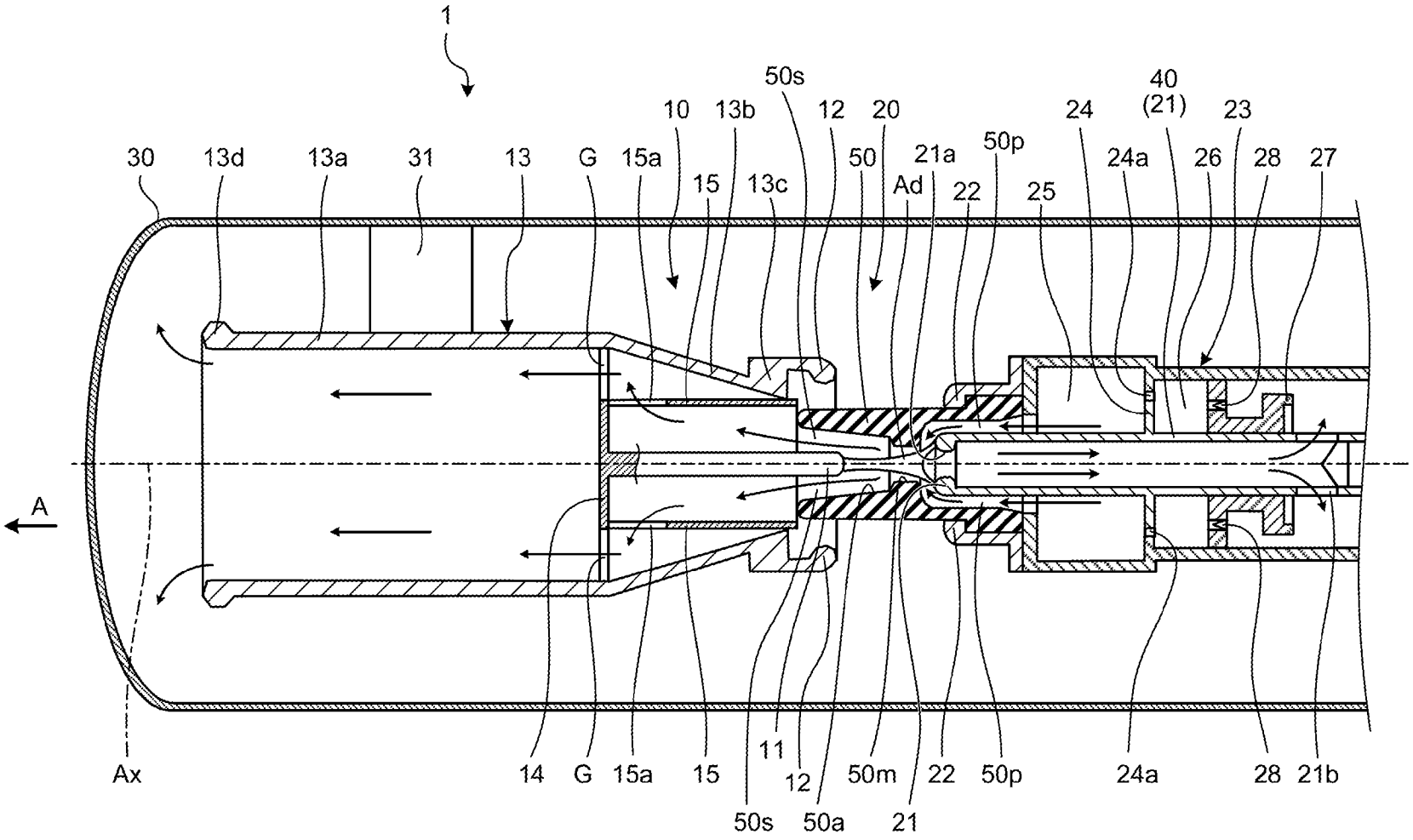
FIG. 3 is a schematic and exemplary cross-sectional view, along the axial direction, of the gas circuit breaker according to the first embodiment, and is a diagram illustrating a cut-off state occurring after the cut-off state illustrated in FIG. 2.
Figure 4:
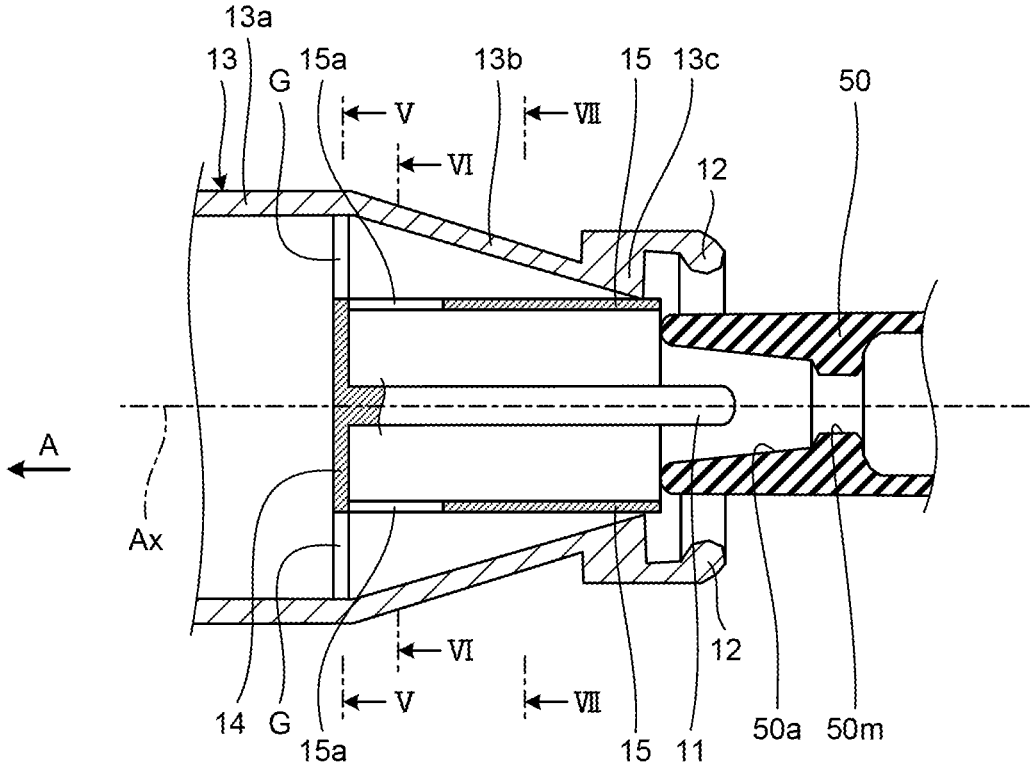
FIG. 4 is a partially enlarged view of FIG. 3.

In the airtight container 30, the two contact parts 10 and 20, that is, a counter contact part 10 and a movable contact part 20 are positioned opposite to each other. The counter contact part 10 and the movable contact part 20 include a plurality of cylindrical or columnar members, and are placed around a central axis Ax concentrically. In the following explanation, "axial direction" represents the axial direction of the central axis Ax, "radial direction" represents the radial direction of the central axis Ax, and "circumferential direction" represents the circumferential direction of the central axis Ax. Meanwhile, the counter contact part 10 represents an example of a counter part, and the movable contact part 20 represents an example of a movable part. In the following explanation, for the purpose of illustration, the side on which the counter contact part 10 is present in the axial direction, that is, the left-hand side in FIGS. 1 to 3 is referred to as an axial direction A; while the side on which the movable contact part 20 is present in the axial direction, that is, the right-hand side in FIGS. 1 to 3 is referred to as an opposite direction of the axial direction A. In the first embodiment, since the counter contact part 10 is fixed to the airtight container 30, it can also be referred to as a fixed contact unit. The counter contact part 10 can be called an opposing contact part, an opposite contact part, or a facing contact part.

From the inner face of the airtight container 30, a support member 31 protrudes inward in the radial direction. The counter contact part 10 is fixed to the airtight container 30 via the support member 31. The support member 31 insulates the airtight container 30 and the counter contact part 10 from each other. Accordingly, the support member 31 can be referred to as an insulating support member.

The movable contact part 20 is connected to an operation rod 40. The operation rod 40 has a cylindrical shape and extends along the axial direction A centering around the central axis Ax, and is able to move in a reciprocating manner along the central axis Ax. The operation rod 40 is moved along the axial direction A by a driving device (not illustrated). In conjunction with the operation rod 40, the movable contact part 20 moves in the axial direction A. When the operation rod 40 moves in the direction toward the counter contact part 10, that is, moves in the axial direction A; the counter contact part 10 and the movable contact part 20 fall in the connected state as illustrated in FIG. 1. On the other hand, when the operation rod 40 moves in the direction away from the counter contact part 10, that is, moves in the opposite direction of the axial direction A; the counter contact part 10 and the movable contact part 20 fall in the cut-off state as illustrated in FIGS. 2 and 3. The operation rod 40 also functions as a discharge pipe enabling discharge of the arc extinguishing gas. That is, the arc extinguishing gas can enter the tube of the operation rod 40 from the end in the axial direction A, pass through the tube, and flow out via an opening 21*b*.

The counter contact part 10 includes a counter arc contact 11 and a counter conducting contact 12. The movable contact part 20 includes a movable arc contact 21 and a movable conducting contact 22. The counter arc contact 11 and the movable arc contact 21 face each other in the axial direction A, and get electrically connected to each other in the connected state. In the case that the counter contact part 10 is fixed to the airtight container 30, the counter arc contact 11 can also be referred to as a fixed arc contact, and the counter conducting contact 12 can also be referred to as a fixed conducting contact.

The counter arc contact 11 is a rod-like electrical conductor, and extends in the axial direction A centering around the central axis Ax. Inside an exhaust pipe 13 of the counter contact part 10, a disc-shaped shield wall 14 is disposed perpendicular to the axial direction A. On the shield wall 14, the counter arc contact 11 protrudes along the central axis Ax toward the opposite direction of the axial direction A.

The movable arc contact 21 is a tubular electrical conductor, and extends along the axial direction A centering around the central axis Ax. In the first embodiment, as an example, the movable arc contact 21 is integrated with the operation rod 40. On the movable arc contact 21, a circular through hole 21*a* is provided at the end in the axial direction A. The end on which the through hole 21*a* is provided is divided by a plurality of slits (not illustrated), which extend along the axial direction A, into a plurality of finger-like electrodes extending along the axial direction A. The ends of the finger-like electrodes are arranged along a circle having a smaller diameter than the outer periphery of the counter arc contact 11. As the operation rod 40 moves, the movable arc contact 21 moves closer to the counter arc contact 11, and the counter arc contact 11 is housed in the through hole 21*a* as illustrated in FIG. 1. As a result, the finger-like electrodes get pressed by the outer periphery of the counter arc contact 11 thereby expanding outward in the radial direction, and make contact with the outer periphery of the counter arc contact 11 due to elasticity of the finger-like electrodes.

The tip of the counter arc contact 11 and the tip of the movable arc contact 21 are covered by an insulating nozzle 50 with a gap (clearance). In other words, the gap is interposed between the tip of the movable arc contact 21 and the insulating nozzle 50, and the gap is interposed between the counter arc contact 11 and the insulating nozzle 50. The insulating nozzle 50 is made of a thermostable and insulating material such as polytetrafluoroethylene. In the first embodiment, as an example, the insulating nozzle 50 is fixed at an end of the movable contact part 20 in the axial direction A, and moves with the operation rod 40 and a cylinder 23 integrally. The insulating nozzle 50 has a cylindrical outer face and extends along the axial direction A centering around the central axis Ax. The insulating nozzle 50 represents an example of a nozzle.

An opening 50*a* is provided in the insulating nozzle 50. The opening 50*a* is a through hole along the axial direction A, and the center of the opening 50*a* is on the central axis Ax. As illustrated in FIG. 1, the counter arc contact 11 can be inserted in a middle portion 50*m* of the opening 50*a* in the axial direction A with a gap (clearance). The middle portion 50*m* can also be referred to as a throat. As illustrated in FIGS. 2 and 3, the movable arc contact 21 is inserted in the opening 50*a* with a gap and is positioned between the middle portion 50*m* and a thermal puffer chamber 25. The gap is a passage 50*p* for the arc extinguishing gas between the middle portion 50*m* and the thermal puffer chamber 25. On the other hand, a conical diameter expansion portion in the opening 50*a* is provided between the middle portion 50*m* and an end of the insulating nozzle 50, the end is an end in the axial direction A. The diameter of the conical diameter expansion portion expands toward the end in the axial direction A. As illustrated in FIG. 3, the diameter expansion portion is a passage 50*s* for the arc extinguishing gas between the middle portion 50*m* and the exhaust pipe 13. The opening 50*a* represents an example of a space.

The counter conducting contact 12 is a cylindrical electrical conductor that extends along the axial direction A centering around the central axis Ax. The counter conducting contact 12 is joined to the outer periphery of an end of the exhaust pipe 13, the end is an end in the opposite direction of the axial direction A. The rim of the opening at an end of the counter conducting contact 12, the end is an end in the opposite direction of the direction A, protrudes inward in the radial direction.

The movable conducting contact 22 is a cylindrical electrical conductor and extends along the axial direction A centering around the central axis Ax. The movable contact part 20 includes the cylinder 23 that has a cylindrical shape and that houses the operation rod 40. The movable conducting contact 22 is joined to an end of the cylinder 23, the end is an end in the axial direction A. As the operation rod 40 moves, the movable conducting contact 22 moves closer to the counter conducting contact 12 and gets inserted in the counter conducting contact 12 as illustrated in FIG. 1. The inner diameter of the rim of the opening of the counter conducting contact 12 is substantially equal to the outer diameter of the movable conducting contact 22. Thus, once the movable conducting contact 22 is inserted in the counter conducting contact 12, an electrical connection is established between the counter conducting contact 12 and the movable conducting contact 22.

In such a configuration, in the cut-off state after the connected state, as illustrated in FIGS. 2 and 3, inside the opening 50*a* of the insulating nozzle 50, an arc discharge Ad is generated between the counter arc contact 11 and the movable arc contact 21. The arc discharge Ad is extinguished by the flow of the arc extinguishing gas. In the following explanation, the flow of the arc extinguishing gas can simply be referred to as the gas flow.

The gas flow is generated inside the cylinder 23. The cylinder 23 is a cylindrical electrical conductor that extends along the axial direction A centering around the central axis Ax. The cylinder 23 is fixed to the operation rod 40. Thus, as the operation rod 40 moves, the cylinder 23 also moves.

Between the cylinder 23 and the operation rod 40, an annular space is provided. The annular space is separated in the axial direction A by a partition wall 24 extending along the radial direction to separate the thermal puffer chamber 25 and a mechanical puffer chamber 26. The gas flow to be blown onto the arc discharge Ad is generated in the thermal puffer chamber 25 and the mechanical puffer chamber 26. On the partition wall 24, a plurality of through holes 24*a* is provided. Thus, the arc extinguishing gas can flow between the thermal puffer chamber 25 and the mechanical puffer chamber 26. The thermal puffer chamber 25 and the mechanical puffer chamber 26 are examples of an accumulation part, and can be referred to as an accumulator space.

In the thermal puffer chamber 25, the pressure of the arc extinguishing gas is raised due to the thermal energy generated by the arc discharge Ad between the counter arc contact 11 and the movable arc contact 21 as illustrated in FIG. 2. Specifically, as illustrated by arrows in FIG. 2, pressure waves generated due to the thermal energy of the arc discharge Ad enter the thermal puffer chamber 25, thereby the pressure in the thermal puffer chamber 25 increase.

A piston 27 fixed to the airtight container 30 is positioned on the opposite side of the partition wall 24 in the mechanical puffer chamber 26. The piston 27 is housed in the cylinder 23 movable relative to the cylinder 23 and the operation rod 40 in the axial direction A. As is clear by comparing FIGS. 2 and 3 with FIG. 1, when the cylinder 23 and the operation rod 40 move toward the opposite direction of the axial direction A, the distance between the partition wall 24 and the piston 27 shortens thereby leading to a decrease in the volumetric capacity of the mechanical puffer chamber 26. Because of the decrease in the volumetric capacity of the mechanical puffer chamber 26, there occurs an increase in the pressure of the arc extinguishing gas in the mechanical puffer chamber 26. Meanwhile, in the piston 27, a relief valve 28 is disposed that opens when the pressure is equal to or greater than a predetermined value. Thus, by the relief valve 28, the pressure inside the mechanical puffer chamber 26 is prevented from increasing to a value equal to or greater than a predetermined value.

As illustrated in FIG. 2, when the arc discharge Ad is generated between the counter arc contact 11 and the movable arc contact 21, the pressure waves of the arc extinguishing gas enter the thermal puffer chamber 25 via the passage 50*p* of the insulating nozzle 50, thereby leading to an increase in the pressure in the thermal puffer chamber 25. Moreover, accompanying the relative movement of the cylinder 23 and the operation rod 40 with respect to the piston 27, there is an increase in the pressure in the mechanical puffer chamber 26. As illustrated in FIG. 3, according to an increase in such kinds of pressure, the arc extinguishing gas in the mechanical puffer chamber 26 flows toward the thermal puffer chamber 25 via the through holes 24*a* and, along with the arc extinguishing gas present in the thermal puffer chamber 25, acts on the arc discharge Ad via the passage 50*p* in the insulating nozzle 50. As a result, the arc discharge Ad is extinguished.

The exhaust pipe 13 includes a cylindrical part 13*a* and a conical part 13*b*. The cylindrical part 13*a* is provided on the side in the axial direction A in the exhaust pipe 13. The conical part 13*b* is provided on the opposite of the axial direction A in the exhaust pipe 13. The conical part 13*b* has a shape tapering gradually from the cylindrical part 13*a* toward an end 13*c* on the side of the movable contact part 20. The conical part 13*b* can also be called a diffuser.

Figure 5:
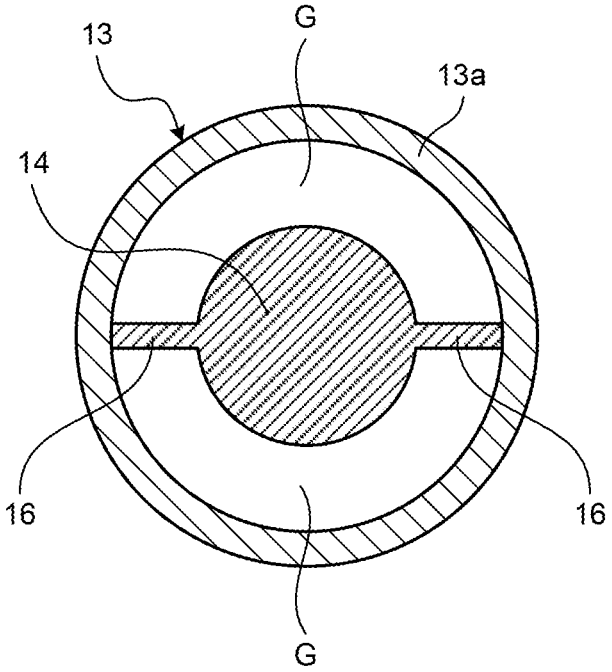
FIG. 5 is a cross sectional view along V-V illustrated in FIG. 4.
Figure 6:
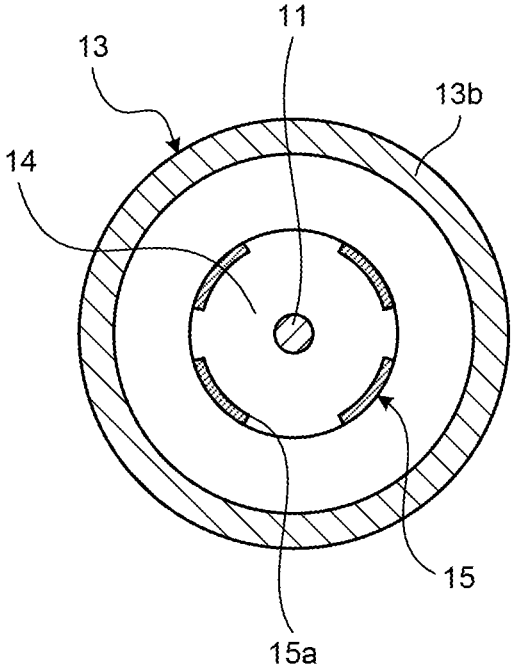
FIG. 6 is a cross sectional view along VI-VI illustrated in FIG. 4.
Figure 7:
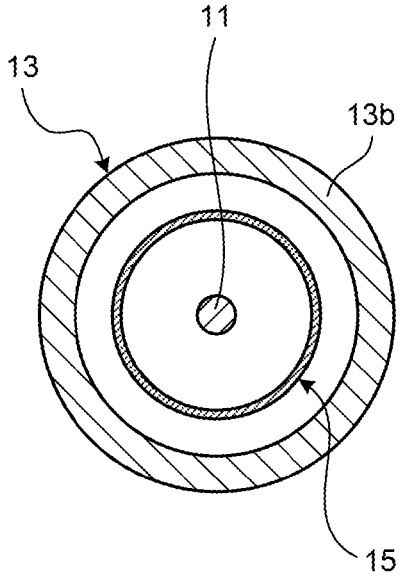
FIG. 7 is a cross sectional view along VII-VII illustrated in FIG. 4.

As illustrated in FIGS. 4 to 7, inside the exhaust pipe 13, shield walls 14 and 15 are disposed. The shield wall 14 is configured to be a disk-shaped wall perpendicular to the axial direction A. The shield wall 14 is supported by support parts 16, which protrude inward in the radial direction from the inner face of the exhaust pipe 13, with a gap G between the shield wall 14 and the inner face of the exhaust pipe 13. The support parts 16 are configured to be rod-like or plate-like in shape, for example. As illustrated in FIG. 5, in the first embodiment, the shield wall 14 is supported by two support parts 16. However, alternatively, there can be only one support part 16 or there can be three or more support parts 16. Herein, the shield wall 14 represents an example of a shield. Moreover, the shield wall 14 can also be referred to as a shielding plate.

The shield wall 15 has a cylindrical shape and extends along the axial direction A centering around the central axis Ax. The shield wall 15 extends from a radially outward end of the shield wall 14 toward the end 13*c* of the exhaust pipe 13 in the opposite direction of the axial direction A. The shield wall 15 makes contact with the end 13*c*, that is, with the rim of the opening of the exhaust pipe 13. Thus, the space between the shield wall 15 and the conical part 13*b* is almost closed by the end 13*c*. The shield wall 15 can have a tubular shape other than the cylindrical shape. For example, the shield walls 15 can have a tubular shape which has a polygonal cross-section. Meanwhile, the shield wall 15 represents an example of a shield. The shield wall 15 can also be referred to as a shielding tube.

As is clear from FIGS. 1 and 2, the insulating nozzle 50 gets inserted in the shield wall 15 and moves in the axial direction A in the shield wall 15. A relatively narrow clearance is provided between the inner face of the shield wall 15 and the outer face of the insulating nozzle 50. Thus, the arc extinguishing gas is prevented from leaking through the clearance between the shield wall 15 and the insulating nozzle 50. The inner face of the shield wall 15 represents an example of a guide that guides the insulating nozzle 50.

On the shield wall 15, through holes 15*a* are provided. Thus, the space inside of the shield wall 15 and the space outside of the shield wall 15 are connected each other via the through holes 15*a*. As illustrated in FIG. 1, the through hole 15*a* are provided to remain open even in the state in which there is maximum amount of movement of the movable contact part 20 in the axial direction A, that is, in the state in which the shield wall 15 and the insulating nozzle 50 overlap over the maximum length.

Thus, as illustrated in FIG. 3, inside the exhaust pipe 13, the arc extinguishing gas from the insulating nozzle 50 flows from the space inside of the shield wall 15 toward the space outside of the shield wall 15 via the through holes 15*a*. Moreover, inside the exhaust pipe 13, the arc extinguishing gas flows from the space on the outside of the shield wall 15 toward the space inside of the cylindrical part 13*a* via the gap G, and gets discharged from an end portion 13*d* of the exhaust pipe 13 into the airtight container 30. In this way, inside the exhaust pipe 13, the shield walls 14 and 15 allow the flow of the arc extinguishing gas through the gap G and the through holes 15*a*. Thus, the gap G and the through holes 15*a* represent passages for the arc extinguishing gas. The gap G can also be referred to as an opening provided on the shield wall 14 including the support parts 16.

In such a configuration, when the arc extinguishing gas rapidly flows into the exhaust pipe 13 from the insulating nozzle 50, there is a risk that the pressure of the arc extinguishing gas increases rapidly inside the exhaust pipe 13 thereby leading to the generation of pressure waves. If a smooth flow of the arc extinguishing gas is obstructed due to the pressure waves, there is a risk that extinguishing of the arc discharge Ad becomes a difficult task to perform more smoothly and more reliably. In this regard, in the first embodiment, the shield walls 14 and 15 appropriately act as resistance elements with respect to the gas flow. Hence, as compared to a case in which the shield walls 14 and 15 are absent, an rapid increase in the pressure inside the exhaust pipe 13 is prevented from occurring thereby possibly alleviating the generation of pressure waves. In the first embodiment, because of the shield walls 14 and 15, bent passages for the arc extinguishing gas are provided inside the exhaust pipe 13. Thus, the shield walls 14 and 15 can also be referred to as bent passage constituting elements or labyrinth constituting elements. As long as the plate-like shield wall 14 is intersecting with the axial direction A within the range of achieving the desired effect, it serves the purpose. Thus, the shield wall 14 need not be completely perpendicular to the axial direction A. Moreover, as long as the tubular shield wall 15 extends along the axial direction A within the range of achieving the desired effect, it serves the purpose and the cross-sectional shape and the diameter of the shield wall 15 need not be constant over the entire range along the axial direction A.

When pressure waves are generated in the cylindrical part 13*a*, there is a risk that the pressure waves travel toward the insulating nozzle 50 and block the flow of the arc extinguishing gas from the insulating nozzle 50 toward the exhaust pipe 13. In this regard, in the first embodiment, by the shield walls 14 and 15, the pressure waves can be prevented from travelling from the cylindrical part 13*a* toward the insulating nozzle 50. Hence, according to the first embodiment, the arc discharge Ad can be extinguished more smoothly and more reliably.

In the first embodiment, the shield wall 15 functions as a guide for guiding the insulating nozzle 50 in the axial direction A. Hence, according to the first embodiment, the insulating nozzle 50 can be prevented from moving away from or tilting with respect to the central axis Ax. Moreover, in the first embodiment, the insulating nozzle 50 is housed movably in the axial direction A in the shield wall 15 with a clearance. Hence, for example, if the clearance is set to be relatively narrower at, for example, few micrometers in diameter difference, then it becomes possible to prevent leaking of the arc extinguishing gas along the periphery of the insulating nozzle 50. Therefore, according to the first embodiment, the arc discharge Ad can be extinguished more reliably and more efficiently. Moreover, in the first embodiment, a plurality of through holes 15*a* is provided on the shield wall 15. Hence, with a relatively simpler configuration, appropriate shielding can be achieved while allowing the arc extinguishing gas to flow inside the exhaust pipe 13, which eventually makes it possible to hold down the generation and propagation of pressure waves.

Meanwhile, in the first embodiment, only the movable contact part 20 is configured to be movable in the axial direction A with respect to the airtight container 30. However, alternatively, the counter contact part 10 can also be configured to be movable in the axial direction A. Moreover, the thermal puffer chamber 25 and the mechanical puffer chamber 26 can be configured integrally. Alternatively, only either the thermal puffer chamber 25 or the mechanical puffer chamber 26 can be disposed.

Modification Examples of First Embodiment

Figure 8:
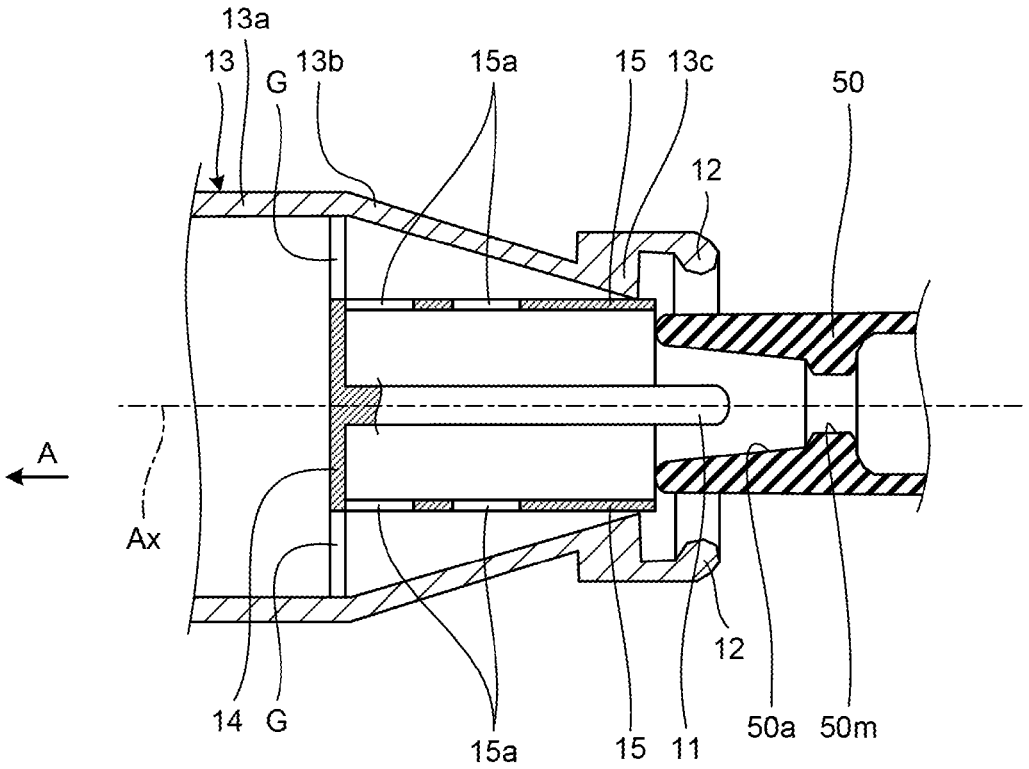
FIG. 8 is a cross-sectional view of a gas circuit breaker, illustrating identical positions to FIG. 4, according to a modification example of the first embodiment.
Figure 9:
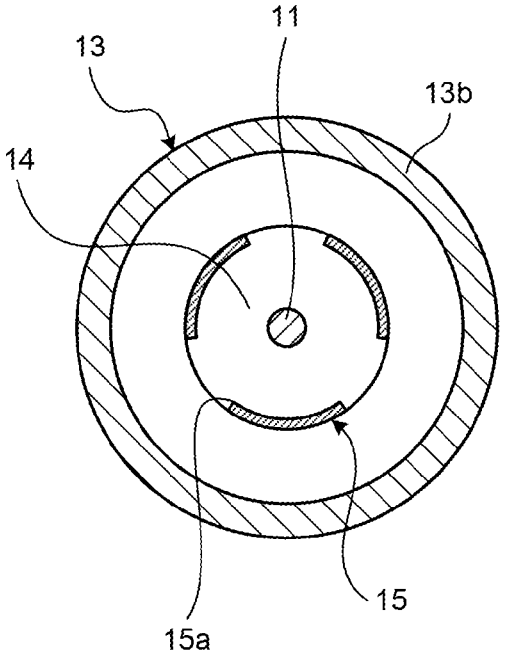
FIG. 9 is a cross-sectional view of a gas circuit breaker, illustrating identical positions to FIG. 6, according to a modification example, different than the modification example illustrated in FIG. 8, of the first embodiment.
Figure 10:
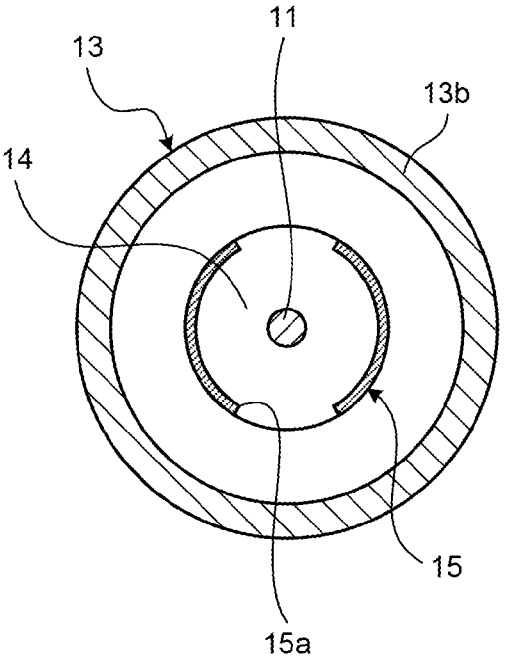
FIG. 10 is a cross-sectional view of a gas circuit breaker, illustrating identical positions to FIG. 6, according to a modification example, different than the modification examples illustrated in FIGS. 8 and 9, of the first embodiment.

As illustrated in a modification example in FIG. 8, on the shield wall 15, a plurality of through holes 15*a* can be provided along the axial direction A. Moreover, as illustrated in modification examples illustrated in FIGS. 9 and 10, on the shield wall 15, a plurality of through holes 15*a* can be provided along the peripheral direction of the shield wall 15. However, the number of through holes 15*a* is not limited to the examples given herein.

Figure 11:
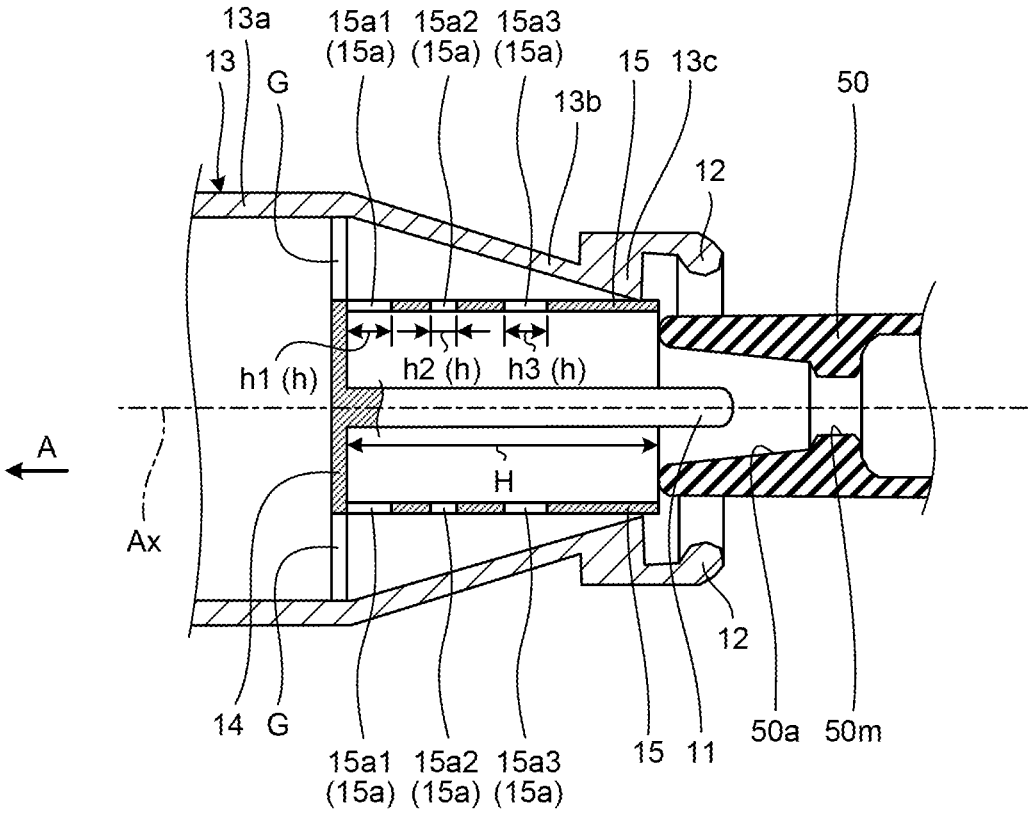
FIG. 11 is a cross-sectional view of a gas circuit breaker, illustrating identical positions to FIG. 4, according to a modification example, different than the modification examples illustrated in FIGS. 8 to 10, of the first embodiment.

In the modification example illustrated in FIG. 11, on the shield wall 15, three through holes 15*a* (through holes 15*a*1, 15*a*2, and 15*a*3) are provided along the axial direction A. The through hole 15*a*1 is provided adjacent to the shield wall 14. The through hole 15*a*2 is provided away from the shield wall 14 as compared to the through hole 15*a*1 and has a smaller opening area than the through hole 15*a*1. The through hole 15*a*3 is provided away from the shield wall 14 as compared to the through holes 15*a*1 and 15*a*2, and has a greater opening area than the through hole 15*a*2. The through holes 15*a*1 and 15*a*3 either can have a substantially identical opening area or can have different opening areas.

The gas flow that first arrives in the exhaust pipe 13 from the insulating nozzle 50 travels to the outside of the shield wall 15 from the inside thereof via the through holes 15*a*3.

In this example, since the opening area of the through holes 15*a*3 is greater than the opening area of the through holes 15*a*2, the gas flow can be smoother initially via the through holes 15*a*3 to the outside of the shield wall 15. When there is an increase in the flow rate of the gas flow from the insulating nozzle 50 to the exhaust pipe 13, the pressure tends to increase in the region close to the shield wall 14 on the inside of the shield wall 15. In this example, since the opening area of the through holes 15*a*1, which are closer to the shield wall 14, is greater than the opening area of the through holes 15*a*2; the gas flow from the region closer to the shield wall 14 inside of the shield wall 15 to the outside of the shield wall 15 can be smoother via the through holes 15*a*.

Figure 12:
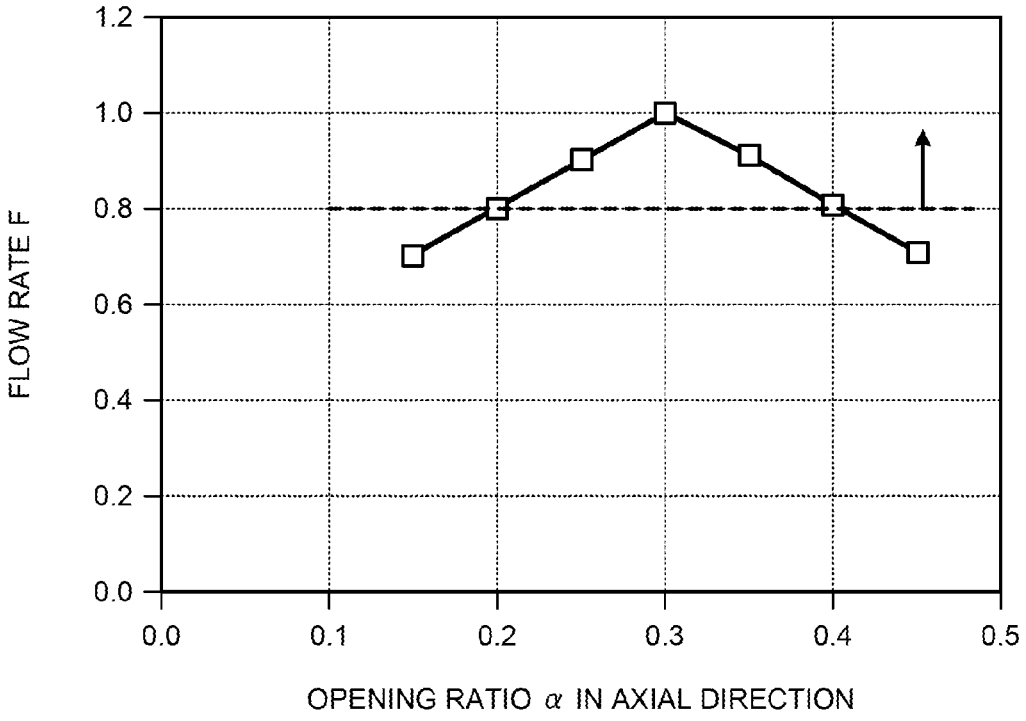
FIG. 12 is a diagram illustrating the correlation between an opening ratio, in the axial direction, of through holes formed on a second shield wall and a flow rate of an arc extinguishing gas in the gas circuit breaker according to the modification example illustrated in FIG. 11.

Meanwhile, as illustrated in FIGS. 8 and 11, when a plurality of through holes 15*a* is provided on the shield wall 15, if the opening area of the through holes 15*a* is too small, the flow resistance of the gas flow in the through holes 15*a* increases and the arc extinguishing efficiency declines. On the other hand, if the opening area of the through holes 15*a* is too large, at the time when the arc extinguishing gas passes through the through holes 15*a*, wakes get formed due to flow separation at the rim of the through holes 15*a*, and the wakes result in an increase in the flow resistance of the gas flow and a decline in the arc extinguishing efficiency. In FIG. 12 illustrated for explaining a specific example, the horizontal axis represents an opening ratio $\alpha$ in the axial direction. Herein, the opening ratio $\alpha$ in the axial direction represents a value in a single row of a plurality of (m number of) through holes 15*a* along the axial direction A, and represents the ratio of a sum total $\Sigma h(=h1+h2+\ldots+hm)$ of an opening height h of a plurality of through holes 15*a* to a height H of the shield walls 15. In the example illustrated in FIG. 3, the number m is 3 (m=3). Meanwhile, the vertical axis represents a flow rate F, which represents the ratio of the flow rate of the gas flow passing through a plurality of through holes 15*a*, which is formed on the shield wall 15, to the total flow rate of the gas flow from the insulating nozzle 50. In the first embodiment, the accumulation part points to the thermal puffer chamber 25 and the mechanical puffer chamber 26. As a result of the diligent research done by the inventors, it was found that the flow rate F becomes equal to or greater than 0.8 when $0.2 \leq \alpha \leq 0.4$ is satisfied as illustrated in FIG. 12, and that the arc can be extinguished with efficiency.

Figure 13:
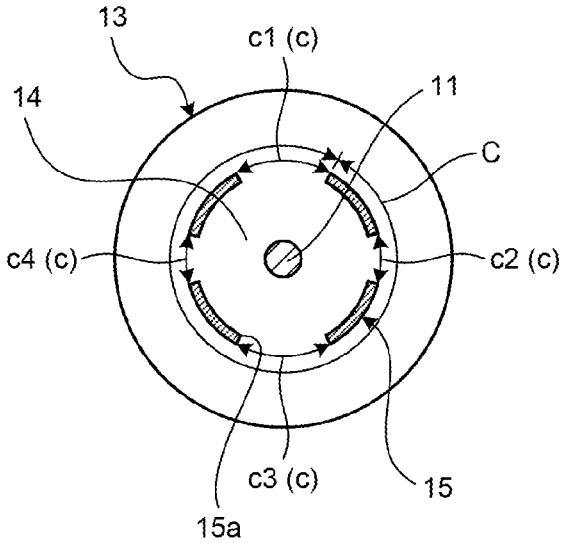
FIG. 13 is a cross-sectional view of a gas circuit breaker, illustrating identical positions to FIG. 6, according to the modification example illustrated in FIG. 11.

Moreover, as a result of the diligent research done by the inventors, regarding an opening ratio $\beta$ in the circumferential direction too, it was found that there exists a range within which the arc can be distinguished with efficiency. That is, the opening ratio $\beta$ in the circumferential direction represents a value in a single row of a plurality of (n number of) through holes 15*a* along the axial direction A as illustrated in FIG. 13, and represents the ratio of a sum total $\Sigma c(=c1+c2+\ldots+cn)$ of an opening width c of a plurality of through holes 15*a* to a circumference length C of the shield walls 15. In the example illustrated in FIG. 13, the number n is 4 (n=4). As a result of the diligent research done by the inventors, it was found that the flow rate F becomes equal to or greater than 0.8 when $\beta \geq 2/3$ is satisfied, and that the arc can be extinguished with efficiency. Meanwhile, in FIG. 12 are illustrated the characteristics when $\beta \geq 2/3$ is satisfied. Moreover, the characteristics of the flow rate F with respect to the opening ratio $\alpha$ in the axial direction and the opening ratio $\beta$ in the circumferential direction have been found to be identical in the case in which the through holes 15*a* are formed in a rectangle shape, or in an elliptical shape, or in a circular shape.

Figure 14:
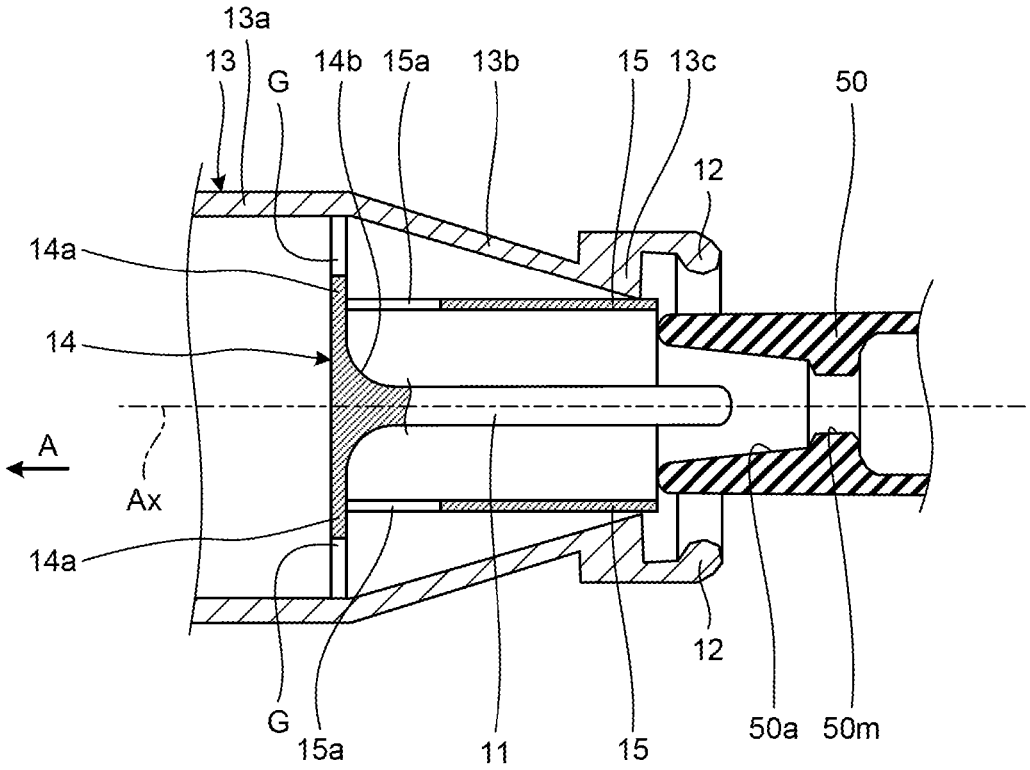
FIG. 14 is a cross-sectional view of a gas circuit breaker, illustrating identical positions to FIG. 4, according to a modification example, different than the modification examples illustrated in FIGS. 8 to 13, of the first embodiment.

In a modification example illustrated in FIG. 14, on the shield wall 14, flanged protection part 14*a* (flange) is disposed that project more outward in the radial direction than the shield wall 15. In the first embodiment, the projection part 14*a* has an annular shape protruding outward in the radial direction around the shield wall 15. The projection part 14*a* can be partially notched, or can have periodic or random asperity provided on the edges thereof. In the modification example illustrated in FIG. 14, because of the projecting portions 14*a*, the gas flow circumvents the outward radial direction of the projection part 14*a*. As a result, a rapid increase in the pressure inside the cylindrical part 13*a* can be further prevented from occurring, and the pressure waves generated inside the cylindrical part 13*a* can be further prevented from propagating to the side of the insulating nozzle 50.

Meanwhile, a tapered part 14*b* is disposed at the base of the counter arc contact 11 protruding from the shield wall 14. The tapered part 14*b* has a tapering shape from the shield wall 14. As a result, a flow separation region in the vicinity of the base of the counter arc contact 11 becomes smaller, which results in a decrease in the resistance to the flow of the arc extinguishing gas. Hence, the arc extinguishing gas can flow more smoothly. As a result, extinguishing of the arc discharge Ad using the arc extinguishing gas can be performed more smoothly and more reliably. Meanwhile, it is desirable that the tapered part 14*b* has a curved face with a sag in the radial direction and the direction approaching the shield wall 14. However, that is not the only possible case.

Second Embodiment

Figure 15:
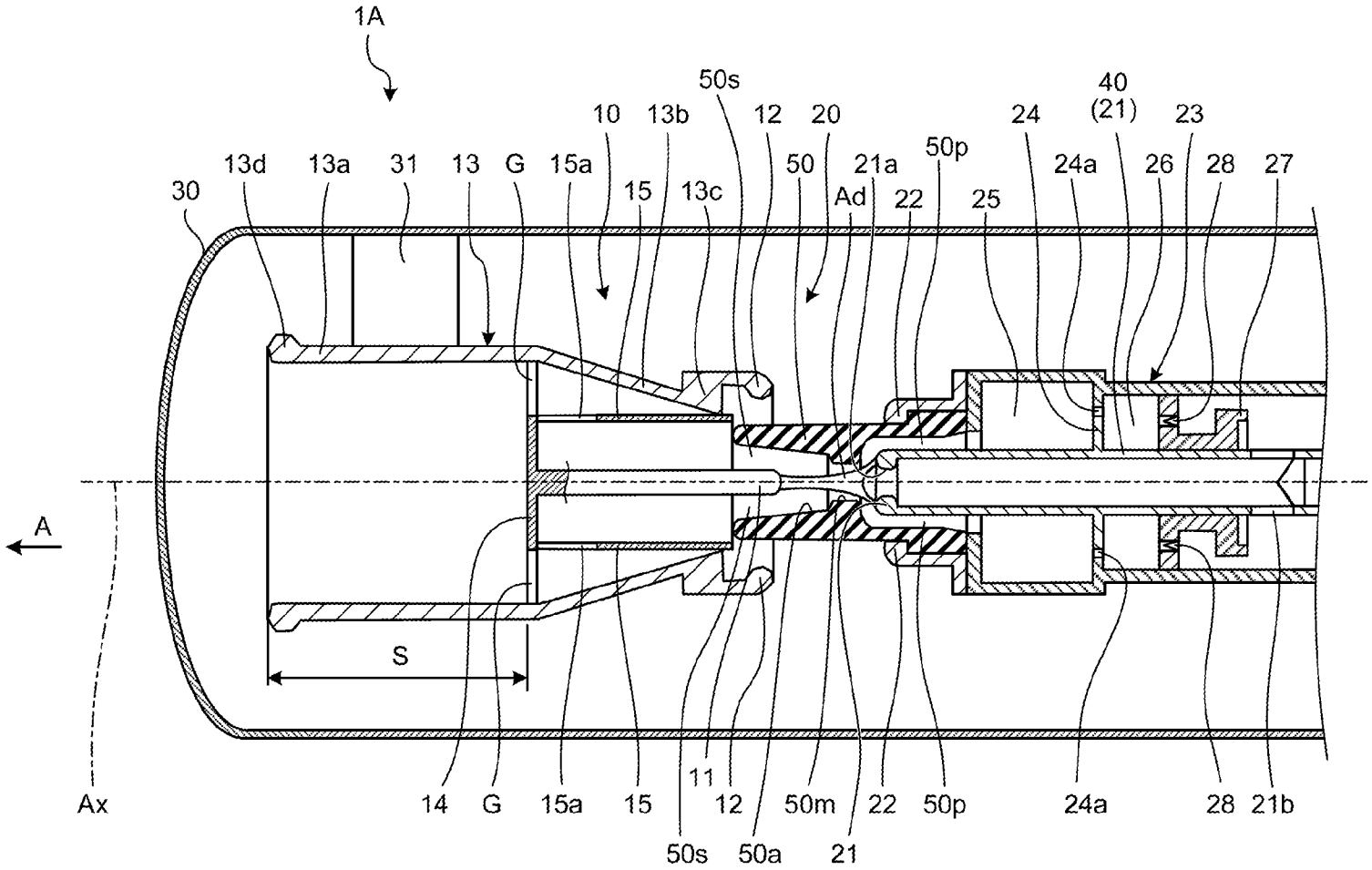
FIG. 15 is a schematic and exemplary cross-sectional view, along the axial direction, of a gas circuit breaker according to a second embodiment.

A gas circuit breaker IA illustrated in FIG. 15 according to a second embodiment has an identical configuration to the first embodiment. Hence, in the second embodiment too, an identical result based on the identical configuration can be achieved. However, in the second embodiment, the distance between the end portion 13*d* and the shield wall 14 is shorter than the wavelength of the pressure waves generated in the exhaust pipe 13, the distance is a length S of the cylindrical part 13*a*. The end portion 13*d* is positioned at the rim of the opening of the exhaust pipe 13. Hence, in the second embodiment, in the cylindrical part 13*a*, that is, inside the exhaust pipe 13, pressure waves are hardly generated or never generated. Thus, in the second embodiment, extinguishing of the arc discharge Ad using the arc extinguishing gas can be performed more smoothly and more reliably.

Third Embodiment

Figure 16:
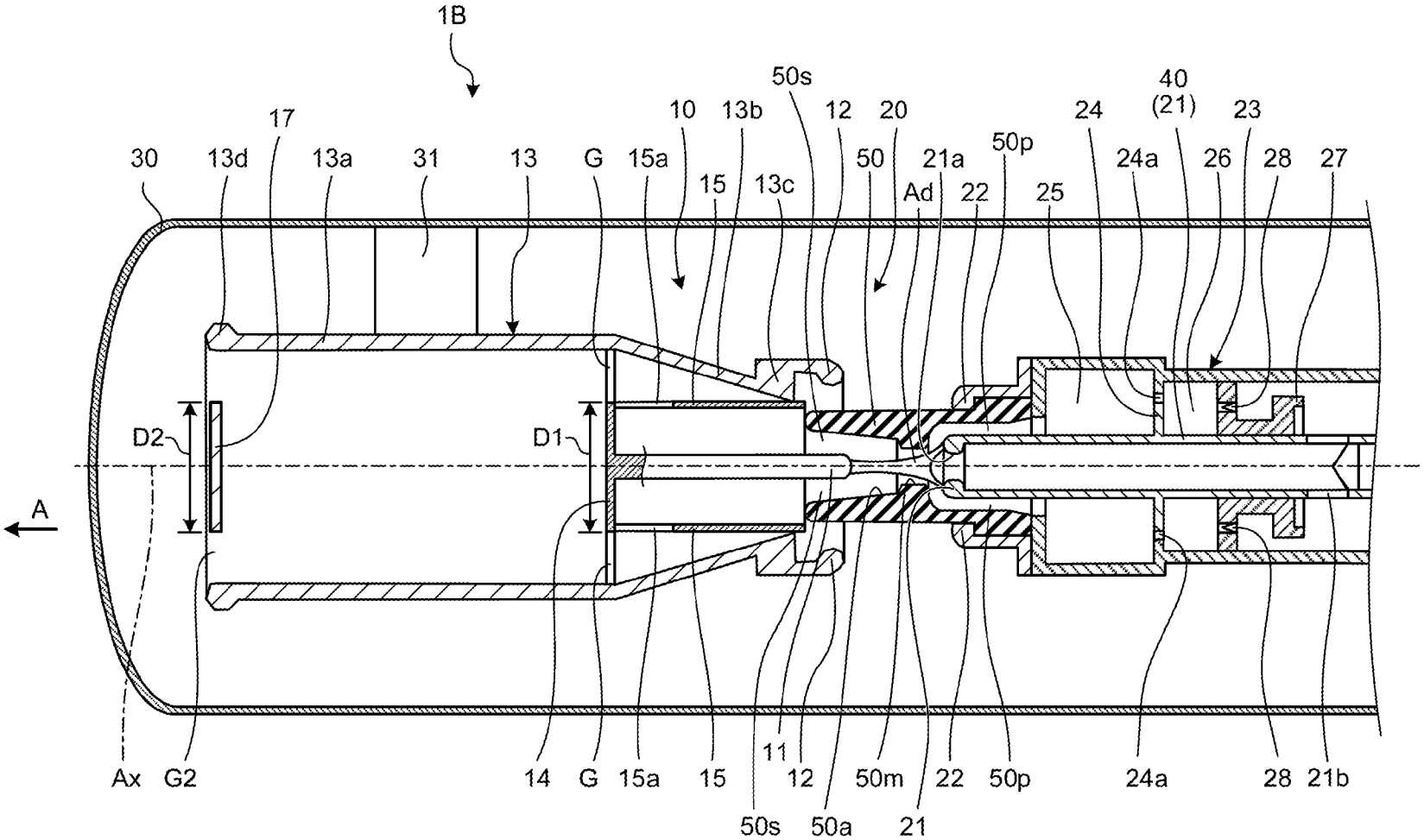
FIG. 16 is a schematic and exemplary cross-sectional view, along the axial direction, of a gas circuit breaker according to a third embodiment.

A gas circuit breaker 1B illustrated in FIG. 16 according to a third embodiment has an identical configuration to the embodiments described above. Hence, in the third embodiment too, an identical result based on the identical configuration can be achieved. However, in the third embodiment, another shield wall 17 is disposed at the outlet side of the exhaust pipe, that is, at the farther side from the movable contact part 20, that is, on the inside of the end portion 13*d* on the left-hand side illustrated in FIG. 16. The shield wall 17 is configured as a disc-shaped wall perpendicular to the axial direction A. The shield wall 17 is supported by a support part (not illustrated) protruding inward in the radial direction from the inner face of the end portion 13*d* of the exhaust pipe 13 with a gap G2 between the inner face of the end portion 13*d* and the shield wall 17. Because of the shield wall 17, the reflection of the pressure waves generated in the cylindrical part 13*a* is prevented from occurring, and consequently the reciprocation of pressure waves (reflection waves) in the cylindrical part 13*a* is prevented from occurring. Thus, according to the third embodiment, it becomes possible to prevent the pressure waves from obstructing a smooth flow of the arc extinguishing gas. As a result, extinguishing of the arc discharge Ad using the arc extinguishing gas can be performed more smoothly and more reliably. Meanwhile, as long as the shield wall 17 is intersecting with the axial direction A within the range of achieving the desired effect, it serves the purpose. Thus, the shield wall 17 need not be completely perpendicular to the axial direction A. Moreover, as a result of the diligent research done by the inventors, it has been found that the effect of using the shield wall 17 is achieved more reliably when a diameter D1 of the shield wall 14 or the shield wall 15 is equal to or smaller than a diameter D2 of the shield wall 17. Herein, the shield wall 17 represents an example of a shield as well as represents an example of a third shield wall.

Fourth Embodiment

Figure 17:
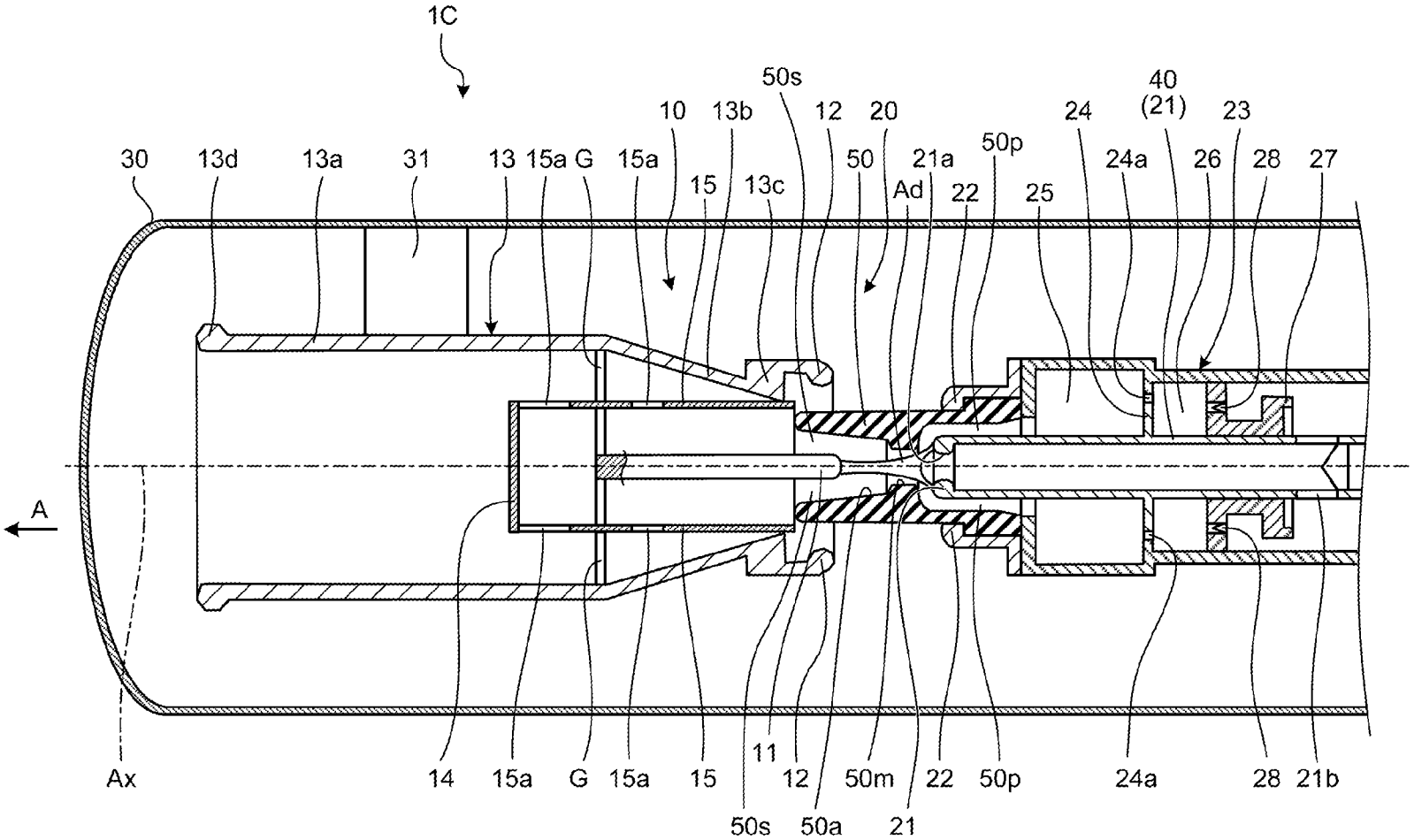
FIG. 17 is a schematic and exemplary cross-sectional view, along the axial direction, of a gas circuit breaker according to a fourth embodiment.

A gas circuit breaker 1C illustrated in FIG. 17 according to a fourth embodiment has an identical configuration to the embodiments described above. Hence, in the fourth embodiment too, an identical result based on the identical configuration can be achieved. However, in the fourth embodiment, the shield wall 15 is longer than in the embodiments and the modification examples explained above. Herein, the farther side of the shield wall 15 from the movable contact part 20, that is, the end portions in the left-hand side in FIG. 17 is positioned inside the cylindrical part 13*a*, and the shield wall 15 extends across the cylindrical part 13*a* and the conical part 13*b*. In such a configuration too, it is possible to achieve an identical effect to the effect achieved in the embodiments and the modification examples described above. Meanwhile, although not illustrated, the shield walls 14 and 15 can alternatively be disposed only inside the conical part 13*b*.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A gas circuit breaker comprising:

a container filled with an arc extinguishing gas;

a movable part housed in the container and including a movable arc contact, the movable part being provided with an accumulation part for increasing pressure of the arc extinguishing gas;

a counter part housed in the container and including a counter arc contact, an exhaust pipe, and a shield, the shield being disposed in the exhaust pipe in a state that a flow of the arc extinguishing gas inside the exhaust pipe is allowed; and a nozzle housed in the container and provided with a space, an arc discharge occurring between the movable arc contact and the counter arc contact in the space, wherein the arc extinguishing gas having an increased pressure in the accumulation part flows into the space to extinguish the arc discharge and flows into the exhaust pipe, the shield has a first shield wall crossing an axial direction of the exhaust pipe, and the first shield wall obstructs flow of the arc extinguishing gas in the axial direction.

2. The gas circuit breaker according to claim 1, wherein the shield has a tubular second shield wall that extends in the axial direction from the first shield wall toward the movable part.

3. The gas circuit breaker according to claim 2, wherein the first shield wall includes a projection part that projects more outward in a radial direction of the exhaust pipe than the second shield wall.

4. The gas circuit breaker according to claim 2, wherein the nozzle is disposed in the movable part, and the second shield wall includes a guide that guides movement of the nozzle.

5. The gas circuit breaker according to claim 2, wherein the second shield wall is provided with a plurality of through holes.

6. The gas circuit breaker according to claim 5, wherein the plurality of through holes includes a first through hole provided adjacent to the first shield wall, a second through hole that is provided away from the first shield wall as compared to the first through hole and that is provided with a smaller opening area than the first through hole, and a third through hole that is provided away from the first shield wall as compared to the second through hole and that is provided with a greater opening area than the second through hole.

7. The gas circuit breaker according to claim 2, wherein a plurality of rows each including a plurality of through holes provided along the axial direction is arranged apart each other in circumferential direction of the exhaust pipe, and in the rows, an opening ratio of sum total of height of the plurality of through holes along the axial direction to height of the second shield wall along the axial direction is equal to or greater than 0.2 and equal to or smaller than 0.4.

8. The gas circuit breaker according to claim 2, wherein the counter arc contact protrudes from the first shield wall.

9. The gas circuit breaker according to claim 8, wherein a tapered part tapering along the axial direction from the first shield wall is disposed at the base of the counter arc contact.

10. The gas circuit breaker according to claim 1, wherein the shield includes a third shield wall, the third shield wall is positioned at an end in the axial direction away from the movable arc contact of the exhaust pipe, and the third shield wall crosses the axial direction.

11. A gas circuit breaker comprising:

a container filled with an arc extinguishing gas;

a movable part housed in the container and including a movable arc contact, the movable part being provided with an accumulation part for increasing pressure of the arc extinguishing gas;

a counter part housed in the container and including a counter arc contact, an exhaust pipe, and a shield, the shield being disposed in the exhaust pipe in a state that a flow of the arc extinguishing gas inside the exhaust pipe is allowed; and a nozzle housed in the container and provided with a space, an arc discharge occurring between the movable arc contact and the counter arc contact in the space, wherein the arc extinguishing gas having an increased pressure in the accumulation part flows into the space to extinguish the arc discharge and flows into the exhaust pipe, the shield has a first shield wall crossing an axial direction of the exhaust pipe, and the first shield wall bends the flow of the arc extinguishing gas.

12. The gas circuit breaker according to claim 11, wherein the shield has a tubular second shield wall that extends in the axial direction from the first shield wall toward the movable part.

13. The gas circuit breaker according to claim 12, wherein the first shield wall includes a projection part that projects more outward in a radial direction of the exhaust pipe than the second shield wall.

14. The gas circuit breaker according to claim 12, wherein the nozzle is disposed in the movable part, and the second shield wall includes a guide that guides movement of the nozzle.

15. The gas circuit breaker according to claim 12, wherein the second shield wall is provided with a plurality of through holes.

16. The gas circuit breaker according to claim 15, wherein the plurality of through holes includes a first through hole provided adjacent to the first shield wall, a second through hole that is provided away from the first shield wall as compared to the first through hole and that is provided with a smaller opening area than the first through hole, and a third through hole that is provided away from the first shield wall as compared to the second through hole and that is provided with a greater opening area than the second through hole.

17. The gas circuit breaker according to claim 12, wherein the counter arc contact protrudes from the first shield wall.

18. The gas circuit breaker according to claim 17, wherein a tapered part tapering along the axial direction from the first shield wall is disposed at the base of the counter arc contact.

19. The gas circuit breaker according to claim 11, wherein the shield includes a third shield wall, the third shield wall is positioned at an end in the axial direction away from the movable arc contact of the exhaust pipe, and the third shield wall crosses the axial direction.

20. A gas circuit breaker comprising:

a container filled with an arc extinguishing gas;

a movable part housed in the container and including a movable arc contact, the movable part being provided with an accumulation part for increasing pressure of the arc extinguishing gas;

a counter part housed in the container and including a counter arc contact, an exhaust pipe, and a shield, the shield being disposed in the exhaust pipe in a state that a flow of the arc extinguishing gas inside the exhaust pipe is allowed; and a nozzle housed in the container and provided with a space, an arc discharge occurring between the movable arc contact and the counter arc contact in the space, wherein the arc extinguishing gas having an increased pressure in the accumulation part flows into the space to extinguish the arc discharge and flows into the exhaust pipe, and the shield has a first shield wall crossing an axial direction of the exhaust pipe and has a tubular second shield wall that extends in the axial direction from the first shield wall toward the movable part.

* * * * *